US009291356B2

(12) United States Patent
Demster

(10) Patent No.: US 9,291,356 B2
(45) Date of Patent: Mar. 22, 2016

(54) EQUIPMENT ENCLOSURE AND METHOD OF INSTALLATION TO FACILITATE SERVICING OF THE EQUIPMENT

(71) Applicant: Stanley J. Demster, Lenexa, KS (US)

(72) Inventor: Stanley J. Demster, Lenexa, KS (US)

( * ) Notice: Subject to any disclaimer, the term of this patent is extended or adjusted under 35 U.S.C. 154(b) by 0 days.

(21) Appl. No.: 14/153,011

(22) Filed: Jan. 11, 2014

(65) Prior Publication Data

US 2014/0196385 A1 Jul. 17, 2014

Related U.S. Application Data

(60) Provisional application No. 61/751,345, filed on Jan. 11, 2013.

(51) Int. Cl.

| | |
|---|---|
| ***F24F 7/02*** | (2006.01) |
| ***F24F 1/02*** | (2011.01) |
| *E04B 7/16* | (2006.01) |

(52) U.S. Cl.

CPC . *F24F 1/022* (2013.01); *E04B 7/16* (2013.01); *E04B 7/166* (2013.01); *F24F 2221/16* (2013.01)

(58) Field of Classification Search

CPC ..... F24F 2221/16; F24F 2221/12; F24F 2221/14; F24F 2221/26; F24F 2221/36; F24F 2221/44; E04B 7/166; E04B 7/16; B60P 3/34

See application file for complete search history.

(56) References Cited

U.S. PATENT DOCUMENTS

| | | | | |
|---|---|---|---|---|
| 592,190 | A * | 10/1897 | Bond | 52/125.2 |
| 911,843 | A | 2/1909 | Sample | |
| 1,461,963 | A * | 7/1923 | Bieneck | 109/47 |
| 2,189,486 | A * | 2/1940 | Amico | 52/67 |
| 2,475,841 | A | 7/1949 | Jones | |
| 2,861,857 | A | 11/1958 | Lee et al. | |
| 3,008,435 | A * | 11/1961 | Dupuy | 109/1 S |
| 3,270,738 | A | 9/1966 | Nielsen | |
| 3,399,887 | A * | 9/1968 | Altier | 472/75 |
| 3,546,827 | A * | 12/1970 | Demarais | 52/29 |
| 3,702,211 | A | 11/1972 | Young et al. | |
| 3,938,766 | A | 2/1976 | Herbolsheimer et al. | |
| 3,993,008 | A | 11/1976 | Parsons, Sr. | |
| 4,118,083 | A | 10/1978 | Lackey et al. | |
| 4,285,391 | A | 8/1981 | Bourner | |
| 4,415,019 | A | 11/1983 | Hunzicker | |
| 4,501,193 | A | 2/1985 | Trigourea | |
| 4,576,508 | A * | 3/1986 | Dickinson | 404/6 |
| 4,666,331 | A * | 5/1987 | Riley | 404/6 |
| 4,715,742 | A * | 12/1987 | Dickinson | 404/6 |
| 4,735,024 | A * | 4/1988 | Rosato et al. | 52/126.6 |
| 4,747,505 | A | 5/1988 | Hansen | |
| 4,976,114 | A | 12/1990 | Manning | |
| 5,129,239 | A | 7/1992 | Thurman | |
| 5,319,895 | A * | 6/1994 | Ray | 52/6 |

(Continued)

FOREIGN PATENT DOCUMENTS

FR 3007058 A1 * 12/2014

*Primary Examiner* — Rodney Mintz

(74) *Attorney, Agent, or Firm* — Erickson Kernell Derusseau & Kleypas, LLC

(57) ABSTRACT

An equipment enclosure system includes an equipment enclosure mounted through a hole in a roof and a chassis supporting the mechanical equipment and which is moveable between a lowered position within the enclosure and a raised position relative to the enclosure to provide access to said equipment. A cover mounted on chassis advances into covering relationship over the enclosure when the chassis is retracted.

11 Claims, 14 Drawing Sheets

(56) References Cited

U.S. PATENT DOCUMENTS

| | | | | |
|---|---|---|---|---|
| 5,462,384 | A * | 10/1995 | Arlandis | 404/6 |
| 5,562,410 | A | 10/1996 | Sachs et al. | |
| 5,632,441 | A * | 5/1997 | Toval | 232/17 |
| 5,642,589 | A * | 7/1997 | Miron et al. | 52/7 |
| 5,794,389 | A * | 8/1998 | Vysma | 52/169.6 |
| 5,832,674 | A | 11/1998 | Ledbetter et al. | |
| 5,832,676 | A * | 11/1998 | Gillmore et al. | 52/67 |
| 5,974,743 | A * | 11/1999 | Vaia | 52/169.6 |
| 6,202,356 | B1 * | 3/2001 | Hock | 52/6 |
| 6,338,596 | B1 * | 1/2002 | Galeazzi et al. | 405/129.5 |
| 6,401,477 | B1 | 6/2002 | Dubé | |
| 6,414,845 | B2 | 7/2002 | Bonet | |
| 6,467,231 | B1 * | 10/2002 | Carlinsky et al. | 52/698 |
| 6,733,094 | B1 | 5/2004 | Chang | |
| 7,562,496 | B2 * | 7/2009 | Zwiebach | 52/64 |
| 7,623,344 | B2 | 11/2009 | Beall et al. | |
| 8,047,448 | B1 * | 11/2011 | Miller et al. | 236/49.3 |
| 8,542,492 | B2 * | 9/2013 | Dunn, Jr. | G06F 1/182 118/500 |
| 2003/0213852 | A1 * | 11/2003 | Demster | 236/49.3 |
| 2003/0213853 | A1 * | 11/2003 | Demster | 236/49.3 |
| 2006/0076425 | A1 * | 4/2006 | Demster | 236/49.3 |
| 2006/0076860 | A1 | 4/2006 | Hoss | |
| 2006/0290248 | A1 | 12/2006 | Chandler | |
| 2008/0196334 | A1 * | 8/2008 | Mangiardi | 52/220.8 |
| 2010/0112930 | A1 * | 5/2010 | Grigsby et al. | 454/333 |
| 2010/0217066 | A1 * | 8/2010 | Ambrosia et al. | 600/21 |
| 2010/0308037 | A1 * | 12/2010 | Mangiardi | 220/3.5 |
| 2010/0313503 | A1 * | 12/2010 | Mangiardi | 52/220.1 |
| 2013/0120920 | A1 * | 5/2013 | Dunn, Jr. | G06F 1/182 361/679.4 |
| 2013/0154296 | A1 * | 6/2013 | Blackwell et al. | 296/24.38 |
| 2015/0252559 | A1 * | 9/2015 | Vieira Lopes | E04B 1/34357 52/1 |

* cited by examiner

EQUIPMENT ENCLOSURE AND METHOD OF INSTALLATION TO FACILITATE SERVICING OF THE EQUIPMENT

FIELD OF THE INVENTION

The present invention relates to enclosures for equipment which facilitate access to the equipment for maintenance. More specifically, the present invention relates to mounting equipment such as rooftop heating, cooling or ventilation equipment through the roof and into the interstitial space below the roof.

BACKGROUND OF THE INVENTION

A common technique used to install heating, ventilation and air conditioning (HVAC) equipment, or other mechanical equipment for supporting building systems or processes, on a roof is to mount the equipment on a curb that rests on the surface of the roof. Generally, the section of roof that is framed by the curb is removed to allow ducts, pipes or electrical conduit to attach to the equipment. Using a curb is beneficial to installing the equipment directly on the roof surface for reasons such as avoiding damage to roofing materials, not blocking roof drainage paths, ensuring the equipment is above standing water or snow, and ensuring that the equipment is always mounted on a level surface.

A drawback of mounting HVAC equipment on the roof in the traditional raised roof curb configuration is that the equipment is highly susceptible to damage and deterioration caused by wind, rain, hail and other forces of nature. The cabinets of the equipment begin to deteriorate over time which can lead to leakage and reduced efficiency. Rooftop equipment is often considered unsightly by owners and architects, and consequently expensive screening is required to camouflage the equipment.

The construction of roof mounted HVAC equipment enclosures or cabinets is well known. A typical HVAC enclosure is illustrated by U.S. Pat. No. 4,118,083 issued to Lackey et al. It describes a cabinet (also commonly referred to as an equipment housing or equipment enclosure) surrounding piping, machinery, and electronics within. U.S. Pat. No. 4,139,052 to Lackey describes a conventional layout and construction of a contemporary roof top unit.

These HVAC equipment cabinets may be round (in the case of exhaust fans) or rectangular (in the case of air handling and self-contained roof top systems). There are often openings in the roof, floor and sidewalls of the cabinets to allow air to flow in or out of the unit and also allow connections to the unit's internal piping and electrical circuitry. Generally, physical access to the internal components is provided by hinged or removable doors in the sidewalls of the cabinet.

Improvements to the basic configuration of roof top mounted mechanical equipment have taken many forms. One such example for stand-alone refrigeration systems and enclosures is illustrated by U.S. Pat. No. 6,401,477 to Dubé. This patent describes a means to improve accessibility to the equipment inside the cabinet for maintenance purposes.

Due to the desire to keep these cabinets light weight and low in cost, they are often formed from light gage metal. Unfortunately, this metal is easily damaged by high winds or hail. Items such as condenser coils are often installed in walls of the cabinets and these coils are also easily damaged by acts of nature.

Gaps at the connection points of cabinet panels and access doors often result in air leaking into or out of the unit. This leakage can result in a substantial energy loss. Access doors are difficult to seal due to the differential pressures created by the circulating air inside the unit. Fastening devices for these doors often bend, break or become lost.

These cabinets are also sources of energy loss for the building due to their relatively low insulation relative to the building roof or walls. Because of the large amount of cabinet surface area exposed to the outdoor temperatures, heat loss through the cabinet can be substantial.

The enclosure is specifically designed to support and contain the internal equipment using a utilitarian approach. Aesthetics and conformance to the building architecture is generally not a consideration. For example, units placed on the roof of a Gothic style building or a modernistic building would have the same style. Architects have been known to refer to the roof mounted mechanical equipment as "roof warts" to denote their less than pleasing appearance. Therefore many buildings do not use roof mounted equipment because of the poor aesthetics that results.

To address the aesthetic issues, architects often design elaborate screening systems that may consist of extended wall parapets, fences mounted on the roof, and similar enclosed structures designed to conceal the equipment enclosures from view. However, these aesthetic measures add significant cost to the building, impair roof maintenance, and can reduce the performance and efficiency of the mechanical equipment. Walls, parapets and other barriers often cause eddy currents on the roof that limit the proper exhaust or intake of environmental air.

SUMMARY OF THE INVENTION

The invention described herein allows mechanical equipment for building systems or processes, such as HVAC equipment, to be installed so that the equipment is recessed into the roof when in service but which may be raised above the roof for maintenance to avoid the drawbacks of the traditional "above curb" configuration. The invention comprises an equipment enclosure which is designed to be recessed into the roof such that an upper end of the enclosure above or at the top of the curb. The invention allows the mechanical equipment to be recessed such that there is minimal, if any, projection of the mechanical equipment above the top of the roof curb or the roof. The invention also includes a means to allow physical access to the equipment via a covered access opening on the equipment enclosure which may also include a mechanism that raises the equipment to a more accessible location. By recessing mechanical equipment such as HVAC equipment into the roof opening framed by the curb, the invention minimizes the equipment's exposure to damaging weather, and also improves the aesthetics of the equipment installation. In some installations, the rooftop equipment may be virtually invisible when viewed from ground level.

It is desirable for the roof curb to extend above the roof from a practical standpoint to prevent the entry of water caused by rain or melting snow. The roof curb height is often dictated by building code. The roof curb is generally flashed, sealed and covered with roofing material by the roofing contractor. The mechanical contractor installs equipment on the roof curb, and the curb may be furnished with the equipment or by a different contractor. This invention may utilize the same traditional roof curbs that are commonly used today for rooftop equipment installation and requires no special features or installation methods. The upper portion of the enclosure, extending above the roof may also be used to form the roof curb.

Another feature of the equipment enclosure system is the arrangement of the equipment and components within the enclosure to permit operation of the equipment in a conventional manner within the recessed location. Generally, outdoor or ambient air must enter and leave the enclosure through openings in the sidewall and roof such as grilles, louvers and other protected openings. With the equipment enclosure system, the air flow path is primarily through the cover of the enclosure with limited air passing through the sidewalls. The equipment enclosure system may include features like high velocity fans, directional louvers and a distinctive configuration for the components including bulkheads such that incoming and outgoing air streams do not mix or interfere with each other.

The equipment enclosure system may provide conventional ductwork connections to the cabinet below the roof plane, similar to traditional connections. One difference between the improved system and traditional rooftop equipment cabinets is that the improved system allows the enclosure or cabinet to recess within the curb and the interstitial space below the roof skin rather than positioning the cabinet on top of the roof curb. Traditionally, the interstitial space below the curb and roof is used for connecting ductwork serving the unit or for adding an occasional field installed item like a damper, smoke detector, heat wheel or similar auxiliary device. The present system can significantly reduce the number of roof penetrations required with a traditional roof curb mounting. This is beneficial because roof penetrations are often the cause of roof membrane failure and moisture leakage.

The invention has several objectives. The primary objective is to conceal most if not all of the mechanical equipment while protecting the equipment from the forces of nature like strong winds and hail. A secondary objective is a reduction in the number of roof penetrations caused by screening systems and equipment connections. Another secondary objective is to reduce energy losses associated with the equipment cabinet by reducing the amount of cabinet area exposed to the outdoor elements. Lastly, the invention improves access to the equipment components while eliminating troublesome access doors and hatches.

DESCRIPTION OF THE PREFERRED EMBODIMENTS

Figure 1:
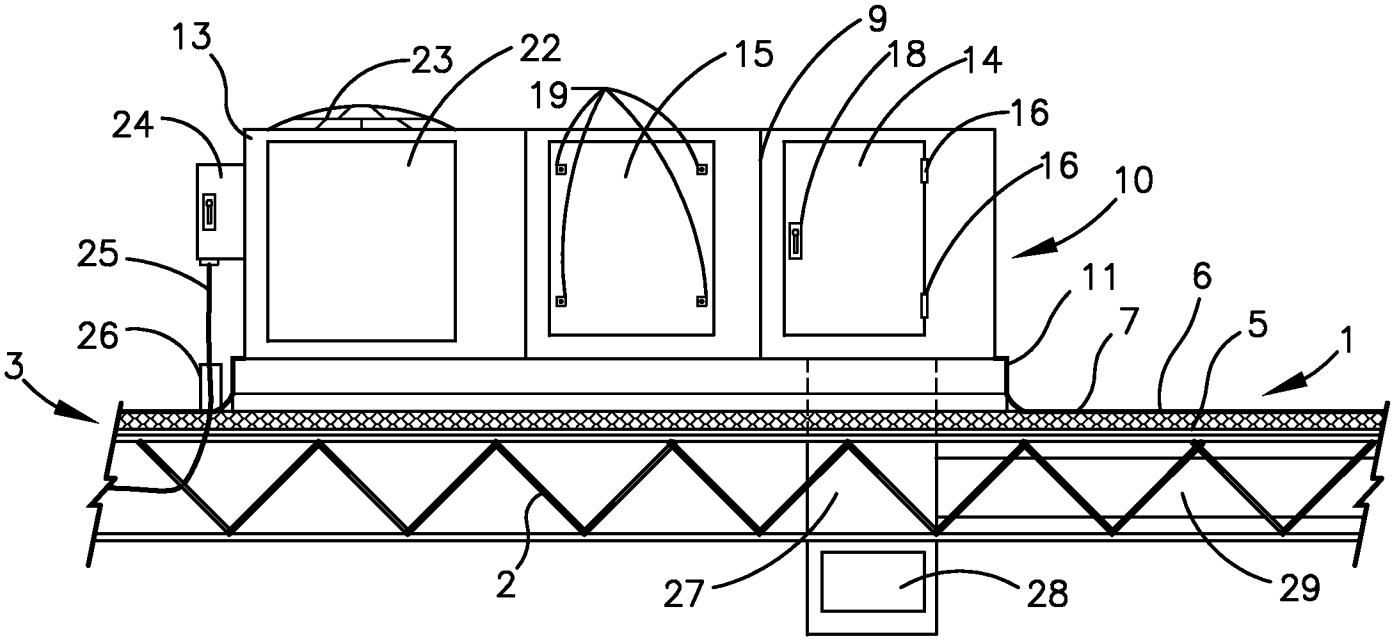
Fig. 1 (prior art)
FIG. 1 is a diagrammatic, side view of a conventional roof top HVAC enclosure system installed on a roof, with the roof shown in cross-section.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly"

and "outwardly" will refer to directions toward and away from, respectively, the geometric center of the embodiment being described and designated parts thereof. Said terminology will include the words specifically mentioned, derivatives thereof and words of a similar import.

For reference purposes, and to provide clear context of the present invention, FIG. 1 is provided to illustrate a commonly utilized method of mounting rooftop HVAC equipment or other mechanical equipment on a roof 1. The roof 1 shown is of the type having structural supports 2 and outer skin, roof skin or roof panel assembly 3. The structural support 2 shown is a truss, but may take other forms including beams, joists or girders and is employed to support outer skin 3 and associated roof mounted equipment. The outer skin 3 typically is formed from a lower layer of decking 5, an intermediate layer of insulation 6 supported on decking 5 and an outer layer or flexible roof membrane 7 covering the insulation 6. Decking 5 typically takes the form of corrugated metal. To support mechanical equipment assembly 10 installed on the roof 1, a roof curb 11 that is flashed into the roof membrane 7 is provided. The roof membrane 7 typically is positioned over the roof curb 11. The purpose of the roof curb 11 is to elevate the connection point of the roof 1 to the mechanical equipment 10 to limit the potential of water entry, while also providing support for the equipment 10.

Referring again to FIG. 1, the mechanical equipment is contained within an enclosure or cabinet 13. A conventional cabinet 13 typically contains access doors 14 or hatches 15 that provide service access to the equipment contained within. The access doors 14 are generally supported by hinges 16 and kept closed by latches 18. The hatches 15 are held closed by fasteners 19 that may be bolts, screws or other type of device that secures the hatch 15 to the cabinet 13. Outside air or ambient air enters the conventional system through louvers 22 or openings 23 in the sidewalls and roof of the cabinet. Electrical power is typically supplied to the equipment by means of a disconnect 24, and a conduit system 25. To allow passage of the conduit system 25 and similar appurtenances like piping and controls cabling, a roof flashing penetration system 26 is required. Ductwork 27 is attached to the cabinet 13 above the roof skin 3. Ductwork 27 is then routed through the roof skin 3 within the confines of the roof curb 11 and then may be routed below the roof support structure 2 as shown by duct 28 or within the space between structural supports as shown by duct 29.

Figure 2:
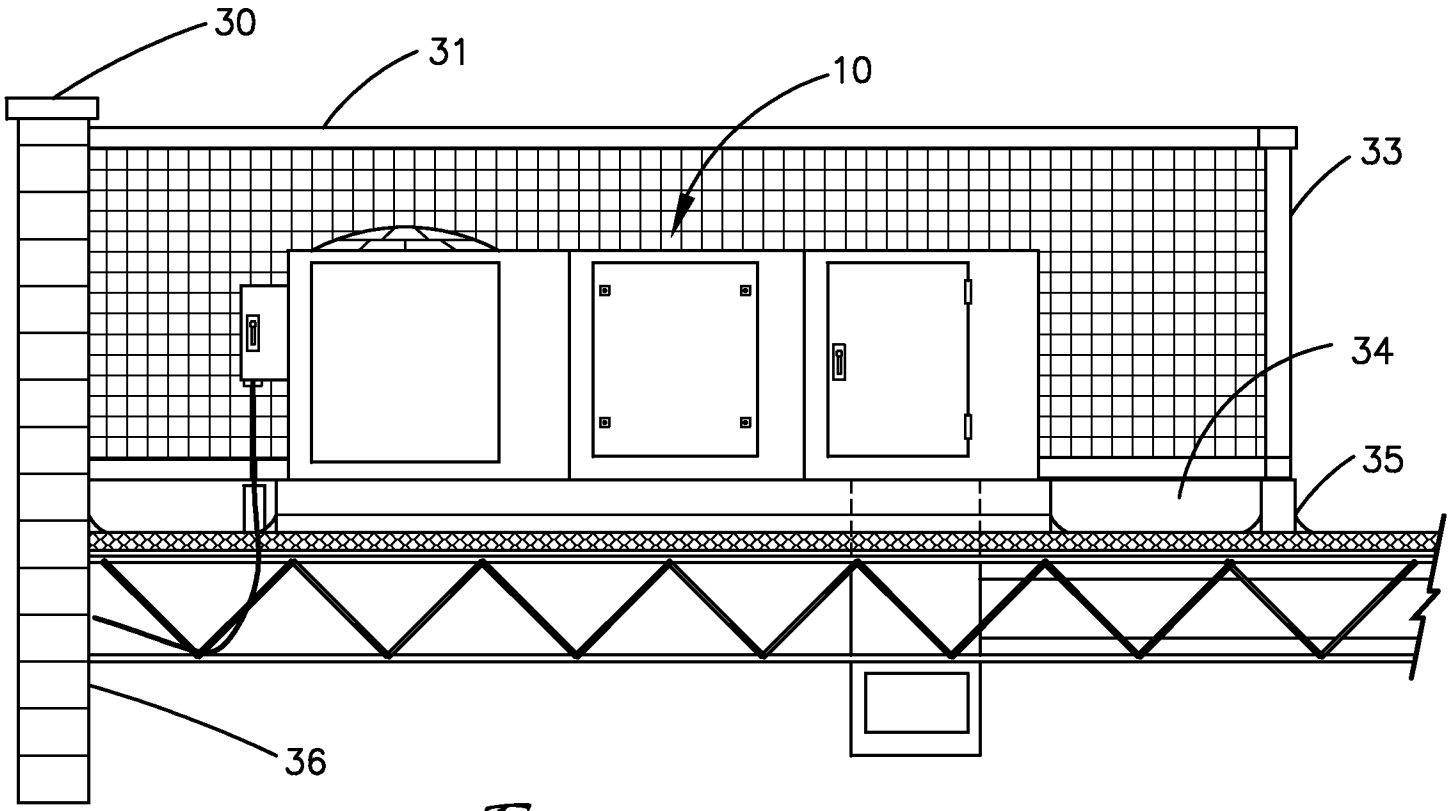
Fig. 2 (prior art)
FIG. 2 is an illustration of the conventional roof top HVAC enclosure system shown in FIG. 1 with the addition of an extended exterior wall or parapet, and a visual screening system similar to a fence to hide the equipment for aesthetic purposes.

FIG. 2 shows a further known configuration of the equipment in FIG. 1 with an added parapet wall 30, and horizontal screening system 31 with vertical support members 33. Ventilation space 34 may or may not be included but additional roof penetrations 35 are required to support the screening system 33. The roof top equipment assembly 10 is unchanged from FIG. 1. Support wall 36 of the building has been extended to form the parapet wall 30 to screen the roof mounted equipment 10.

Figure 3:
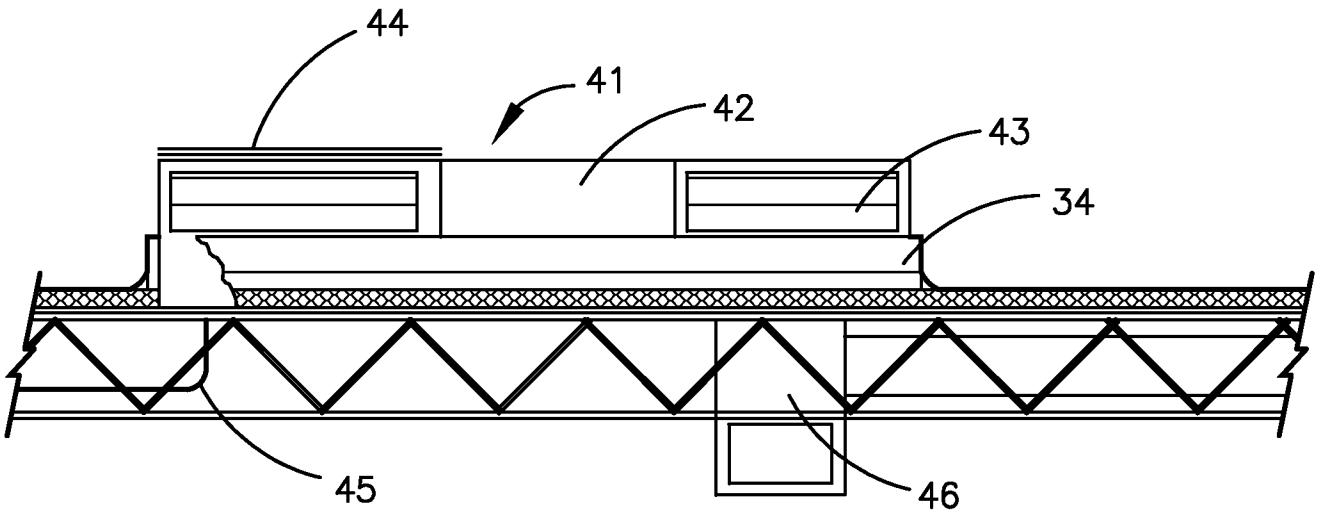
FIG. 3 is a diagrammatic side view of an improved roof top equipment enclosure system mounted at a reduced height with an equipment enclosure recessed into the curb space but not the interstitial space below the roof.

FIG. 3 depicts a simplified view of an improved equipment enclosure system of the present invention. The equipment enclosure systems of the present invention are particularly well adapted for use in enclosing mechanical equipment such as HVAC equipment, cooling water chillers, boilers, furnaces, power generators or the like which are used for supporting building systems or processes such as heating or cooling systems, ventilation systems and power supply systems.

HVAC equipment and chillers or boilers are adapted for moving fluids such as air or water through a building or processing equipment and may be referred to herein as air handling equipment when moving air and more generally as fluid handling equipment when moving fluids including air and water. Such air handling or fluid handling equipment may include equipment or components for heating or cooling or otherwise conditioning the air or fluids to be distributed by the fluid handling equipment. The air handling or fluid handling equipment may also be referred to as mechanical equipment.

As used herein, mechanical equipment may also include equipment adapted for supplying or distributing power into a building for use by building systems or processing equipment therein. For example and as used herein, a generator may be described as mechanical equipment.

The construction of roof 1 including roof curb 11 is generally the same as described in FIGS. 1 and 2. However, cabinet 42 and the mechanical equipment assembly 41 enclosed therein is now recessed into the roof curb 10 such that the bottom of cabinet 42 is supported on or just above the roof decking 5. This partial lowering of the cabinet 42 and equipment assembly 41 permits louvers 43 and vents 44 to remain installed in cabinet 42 in their conventional locations. An electrical supply conduit 45 and similar appurtenances are now routed directly to the cabinet from below the roof. Ductwork 46 is attached to the cabinet 42 through and just above the decking 5. The mechanical equipment (not visible) within the cabinet 32 may be rearranged from its traditional configuration to permit construction of a lower profile cabinet 42 if possible.

In embodiments described subsequently, the cabinet or equipment enclosure is recessed through and below the roof skin 3 and into the interstitial space extending below the roof skin 3. There are several reasons that the equipment enclosure may not be fully recessed into the roof interstitial space. First, there may be a need to keep the lower plane of the equipment enclosure above the roof surface for aesthetics or reasons of structural system interference. Second, there may also be a need for large air intake and exhaust openings which require significant portions of the equipment enclosure remain above the roof skin. Third, the physical size of the components inside the equipment enclosure 42 may simply be too tall to fully conceal the equipment enclosure in the interstitial space below the roof.

Figure 4:
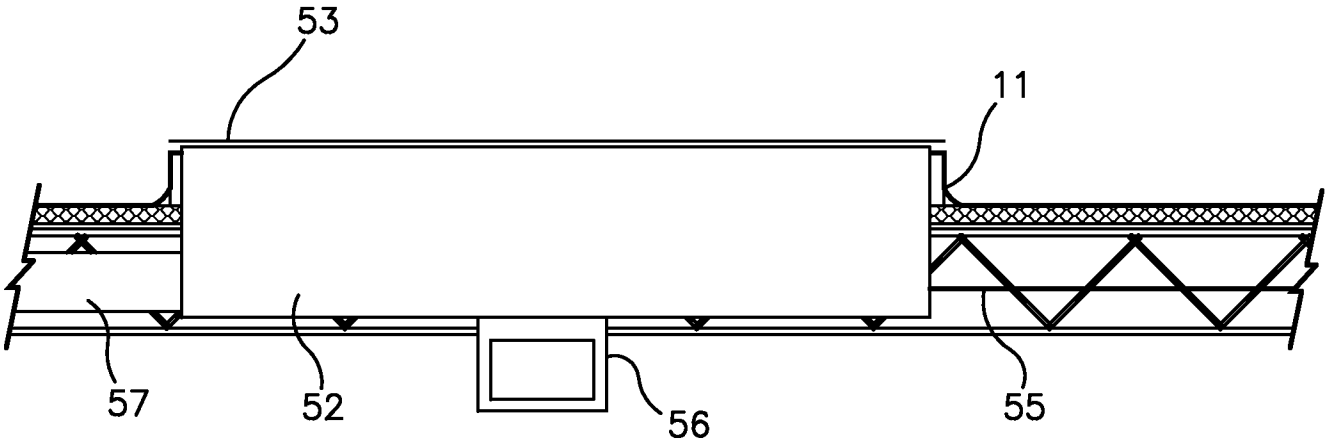
FIG. 4 is a diagrammatic side view of an alternative embodiment of the improved roof top equipment enclosure system in which an enclosure or cabinet containing mechanical equipment is fully recessed into the curb and the interstitial space below the roof.

FIG. 4 discloses a diagrammatic view of an equipment enclosure system 50 of the present invention with a cabinet or equipment enclosure 52 completely recessed into the roof curb 11 and interstitial space below the roof skin 3 thus requiring vents/louvers 53 to be located in a roof or top panel 54 of the cabinet 52. As used herein, the interstitial space may include the space located below the roof decking 5 but generally above the habitable or usable portion of the room extending therebelow. The interstitial space includes and may be limited to the space between the roof structural supports 2 or may extend therebelow including any space extending to a ceiling such as a drop ceiling. As used herein, roof may include the upper skin or covering layer of a structure buried in the ground such that the roof may extend at ground level or below ground level. It is also foreseen that the equipment enclosure may be mounted through a floor that covers an interstitial space inside of a building for housing mechanical equipment. For example, a building may be constructed to include an interstitial space between every third floor to accommodate mechanical equipment. As used herein, the term roof may include such floors over interstitial spaces.

Electrical conduit 55 and other similar appurtenances are routed directly to the cabinet 52 in the interstitial space. Ducts 56 and 57 are connected to the cabinet 52 in the interstitial space. FIG. 4 shows the mechanical equipment 51 lowered into the cabinet 42 in an operational mode. All of the air that is exhausted or drawn in from ambient passes through the top panel 54 of the cabinet 52. A relatively shallow cabinet with this embodiment may require only a hinged or lift off top panel 52 to permit servicing of the interior components. However, deeper cabinets common to larger sizes will require a lifting mechanism for lifting the mechanical equipment upwards, out of the cabinet to gain access to the components of the mechanical equipment 51 for service. An example of one embodiment of a lifting mechanism 60 is shown in FIGS. 5, 7 and 8.

Figure 5:
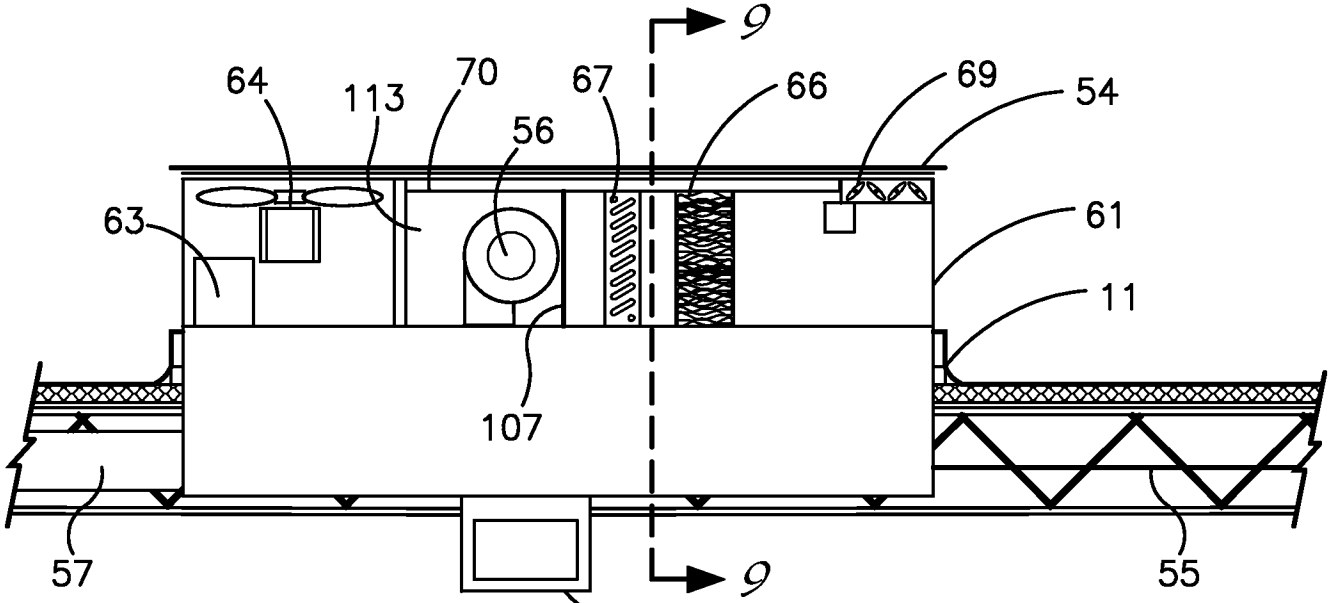
FIG. 5 is a diagrammatic view of the system as shown in FIG. 4 showing the mechanical equipment mounted on a chassis raised from within the enclosure for service.

FIG. 5 is a diagrammatic view of the equipment enclosure system 50 with a recessed cabinet 52 as shown in FIG. 4 showing the mechanical equipment assembly 51 positioned in a service mode with components raised out of the cabinet 52 and above roof curb 11 to provide easy access and facilitate maintenance and repair. In the embodiment shown, the mechanical equipment 51 is mounted on a frame or chassis 61 which may be raised and lowered relative to cabinet 52. Representative components of the mechanical equipment 51 mounted on chassis 61 and positioned for relatively easy access for maintenance and repair include one or more compressors 63, fans 64, blowers 65, filters 66, and an evaporator or cooling coils 67. Other equipment that could be housed in the enclosure might include heat exchangers, pumps, chillers, burners and the like. No hatches or access doors are required. Ambient air dampers 69 and cabinet liners/insulation 70 can also be maintained and cleaned in this position. This embodiment uses the lifting mechanism 60 to raise and lower the chassis 61 as well as seal the cabinet 52 by compressing a gasket 72 between a peripheral edge of the top panel 54 mounted on chassis 61 and an upper edge or lip 73 of cabinet 52.

Figure 6:
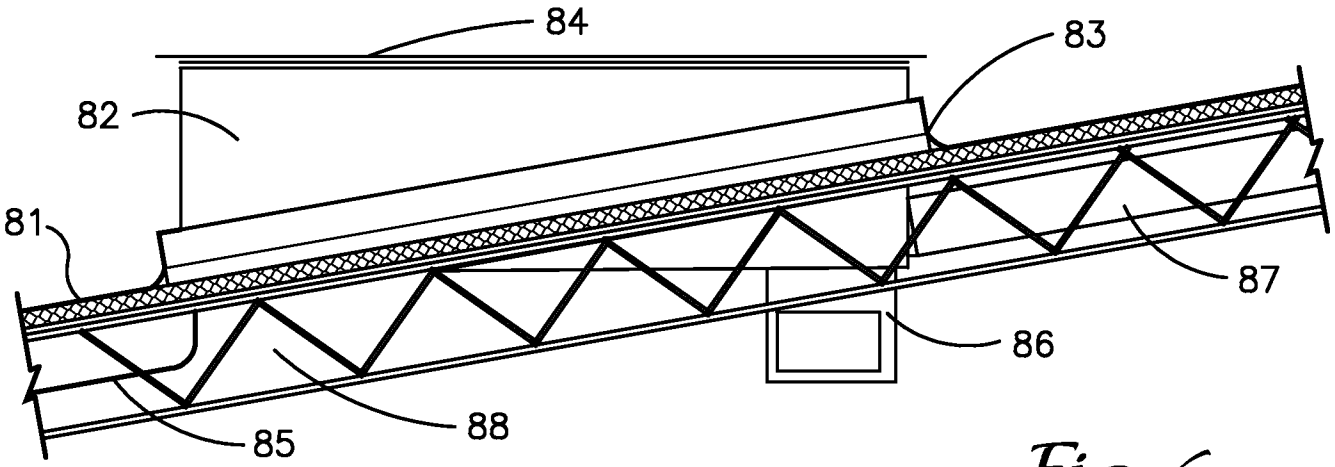
FIG. 6 is a diagrammatic side view of an alternative embodiment of the improved equipment enclosure system mounted on an inclined roof with the equipment enclosure recessed into the curb and roof in a manner that maintains a level slope of the equipment enclosure and equipment enclosed therein.

Because not all roof systems are flat and horizontal, FIG. 6 illustrates how the improved air handling system 50 may be used with an inclined roof 81. The cabinet 82 is installed within the curb 83 in a manner that keeps the equipment level. Ventilation is provided through louvers/openings in the cabinet top panel or cover 84 and conduit 85 and ducts 86 and 87 are connected to the cabinet 82 below the roof skin 3 within the interstitial space 88.

Figure 7:
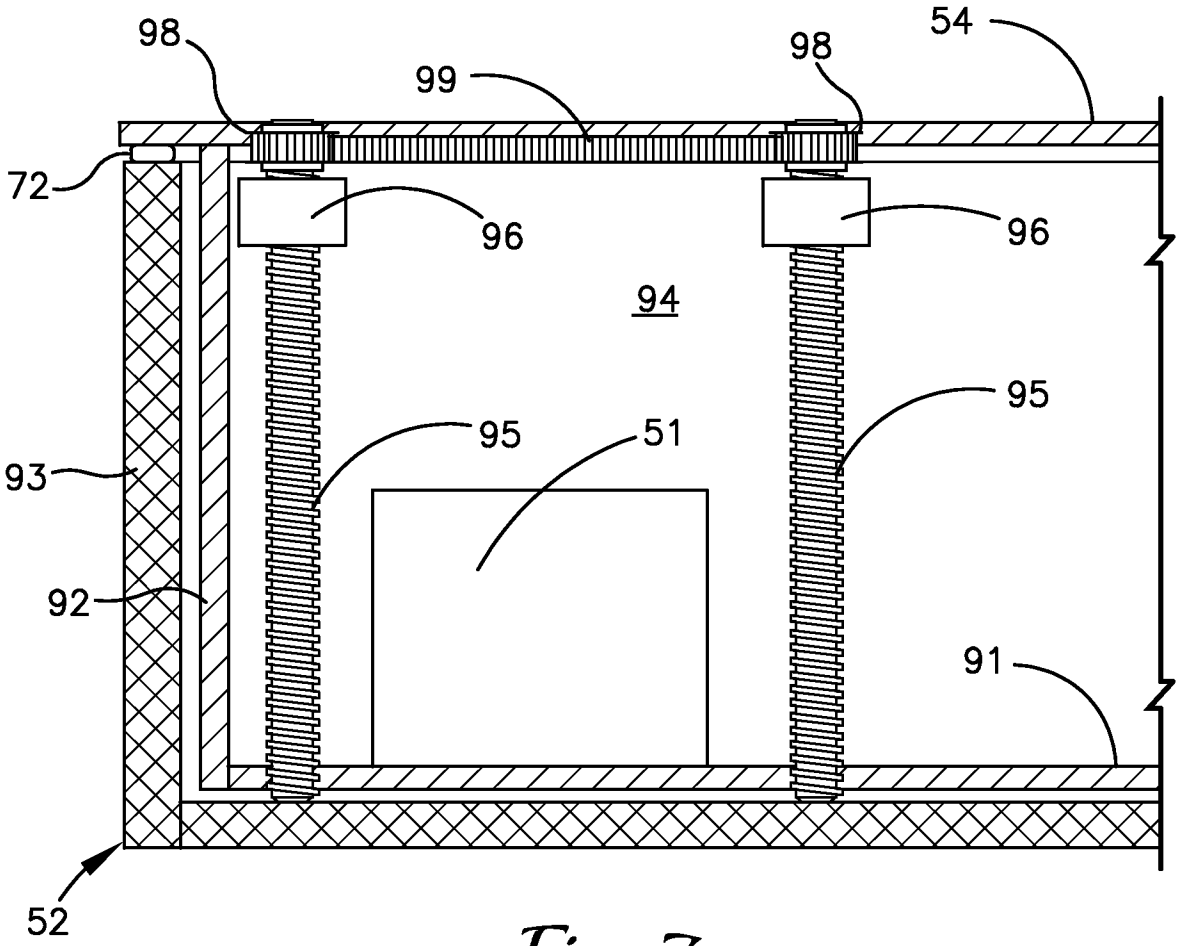
FIG. 7. is a schematic, fragmentary, cross-sectional view of the equipment enclosure showing the chassis for supporting the equipment within the enclosure and showing a lift mechanism for raising and lowering the chassis and equipment relative to the enclosure.
Figure 8:
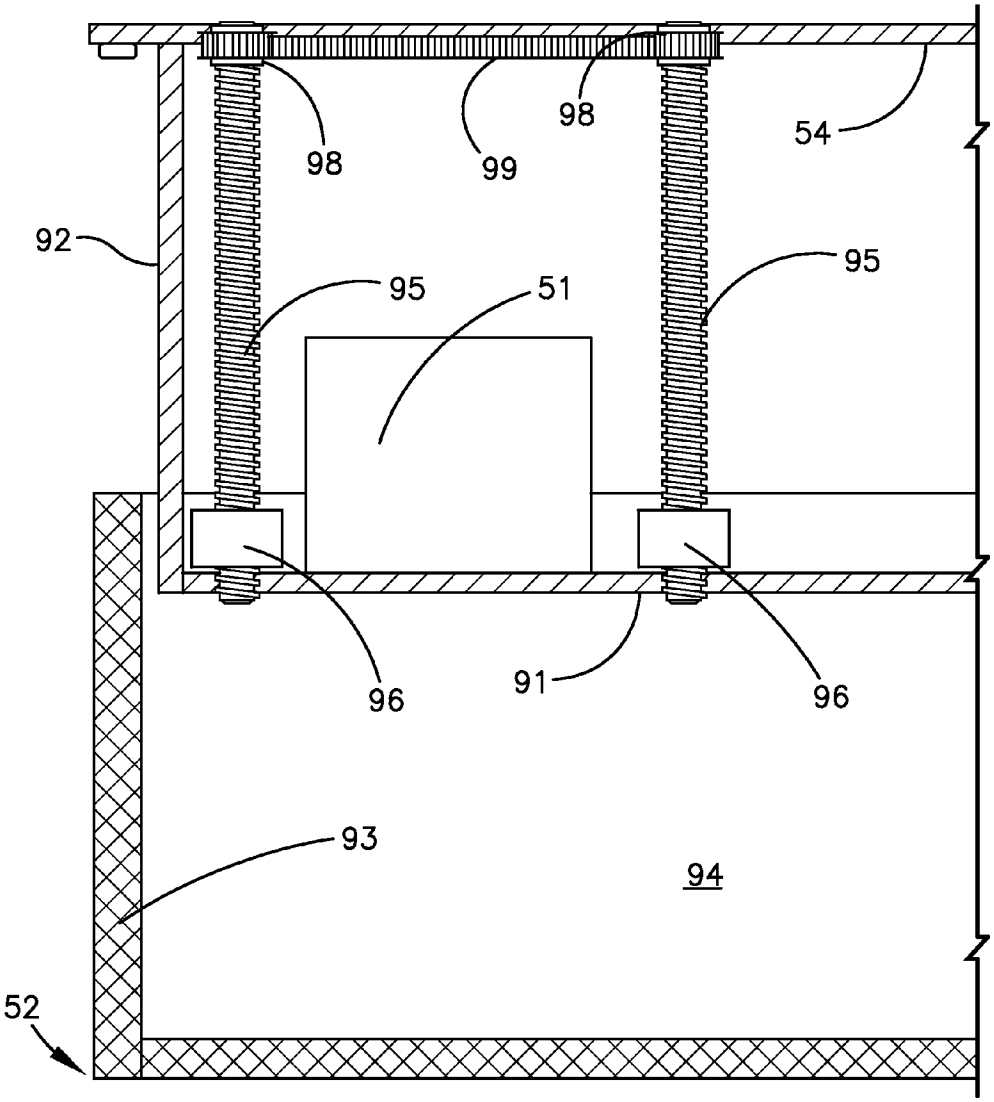
FIG. 8 is a view similar to FIG. 7 showing the chassis and equipment supported thereon raised to facilitate servicing or maintenance of the equipment.

An embodiment of a suitable lifting mechanism 60 for the present invention is shown diagrammatically in FIGS. 7 and 8. Block 51 is representative of one of the components of the mechanical equipment 51 mounted on chassis or open frame 61. Chassis 61 shown is formed as a rectangular or cuboid frame with longitudinally extending side rails 91 and end rails (not shown) suspended from the top panel or cabinet cover 54 by vertical frame members or posts 92. In FIG. 7, the chassis 61 is retracted into cabinet 52. The cabinet cover panel 54 extends over the cabinet end walls 93 and sidewalls 94 to form a weather tight seal using conventional means of sealing such as a gasket type seal 72 on either the underside of the overhanging lip of cabinet cover panel 54 or on the top of the cabinet sidewall 94. The lift mechanism as shown consists of a plurality of acme screws 95 rotatably mounted at lower ends to side rails 91 and at upper ends through the cabinet cover panel 54. Each acme screw 95 extends through and threadingly engages a threaded bearing 96 attached to a cabinet sidewall 94. Screws 95 are operated by attached sprockets 98 and timing belt 99 or a chain. Timing belt 99 may be motor driven or driven by a hand tool such as a battery operated drill with a bit engaging a socket (not shown) formed in an upper end of one or more of the screws 95 to raise and lower the chassis 61. It is also foreseen that a tool engageable head (such as a hexagonal shaped head) may be formed on the upper end of one or more of the screws 95 to be engageable by a socket on a power tool. As shown in FIG. 7, the chassis 61 and attached equipment 51 are in the lowered or operating position relative to cabinet 52.

In FIG. 8, the chassis 61 and mechanical equipment 51 are shown raised to the service position by lifting mechanism 60. The linear screw mechanism 61 is just one of many possible lift mechanisms that could be used to provide the linear motion required to raise, lower and secure the chassis 61 in the cabinet 52. The raising and lowering may be driven by hand crank, lever, wheel or automatically operated by an internal motorized system or external portable motorized device. Use of a separate, external power source, separate from any power supplied to the mechanical equipment 51 or cabinet 52 is preferable for use in raising and lowering the chassis 61 relative to cabinet 52, as the power to the equipment 51 and cabinet 52 is typically disconnected before or during lifting of the chassis 61. The raising and lowering system should be capable of locking in the raised or lowered position for maintenance purposes.

Figure 9:
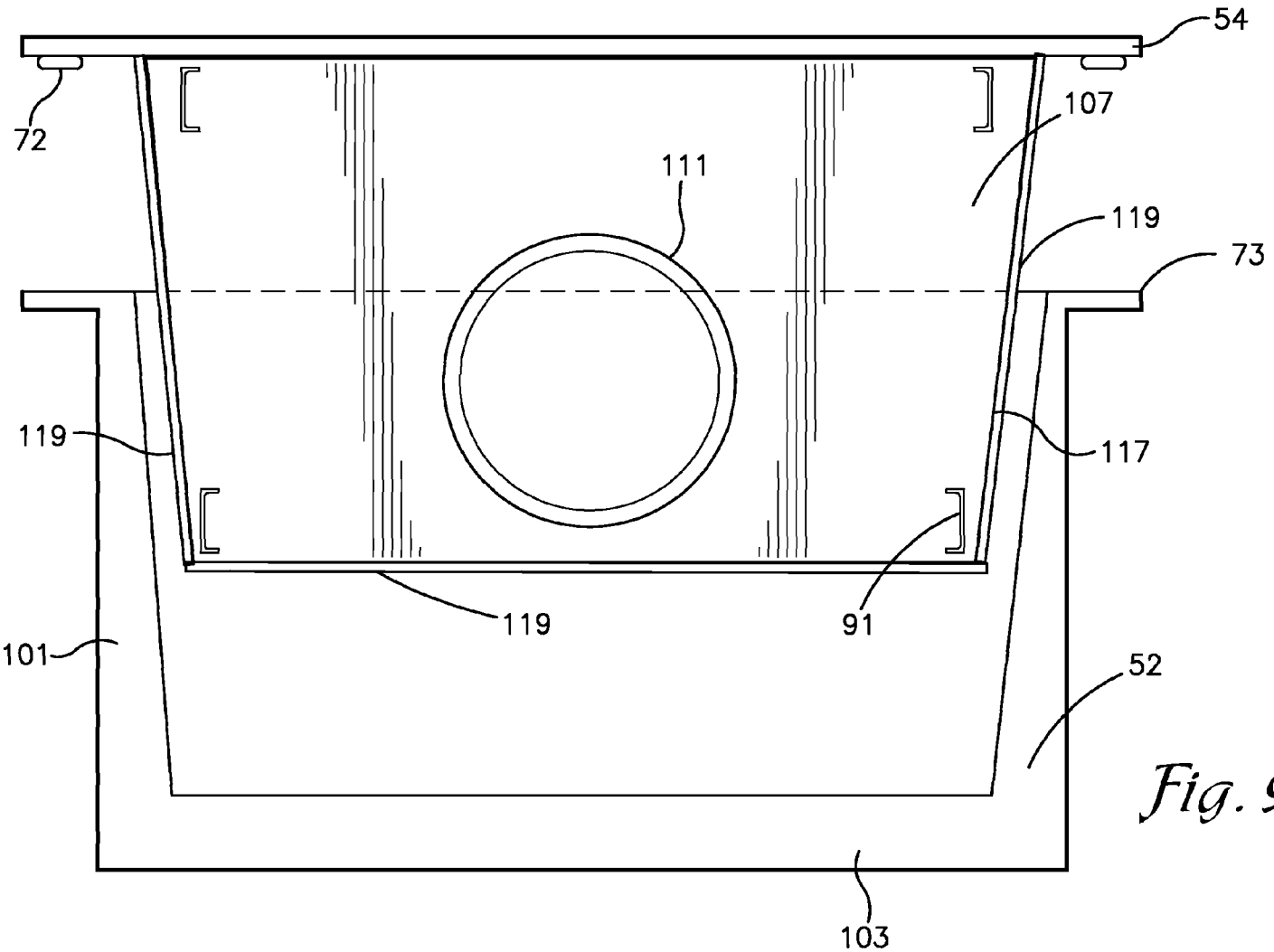
FIG. 9 is a diagrammatic, cross-sectional view of the chassis partially raised relative to the enclosure and showing a chassis bulkhead used to control air flow and compartmentalize the interior of the enclosure.
Figure 10:
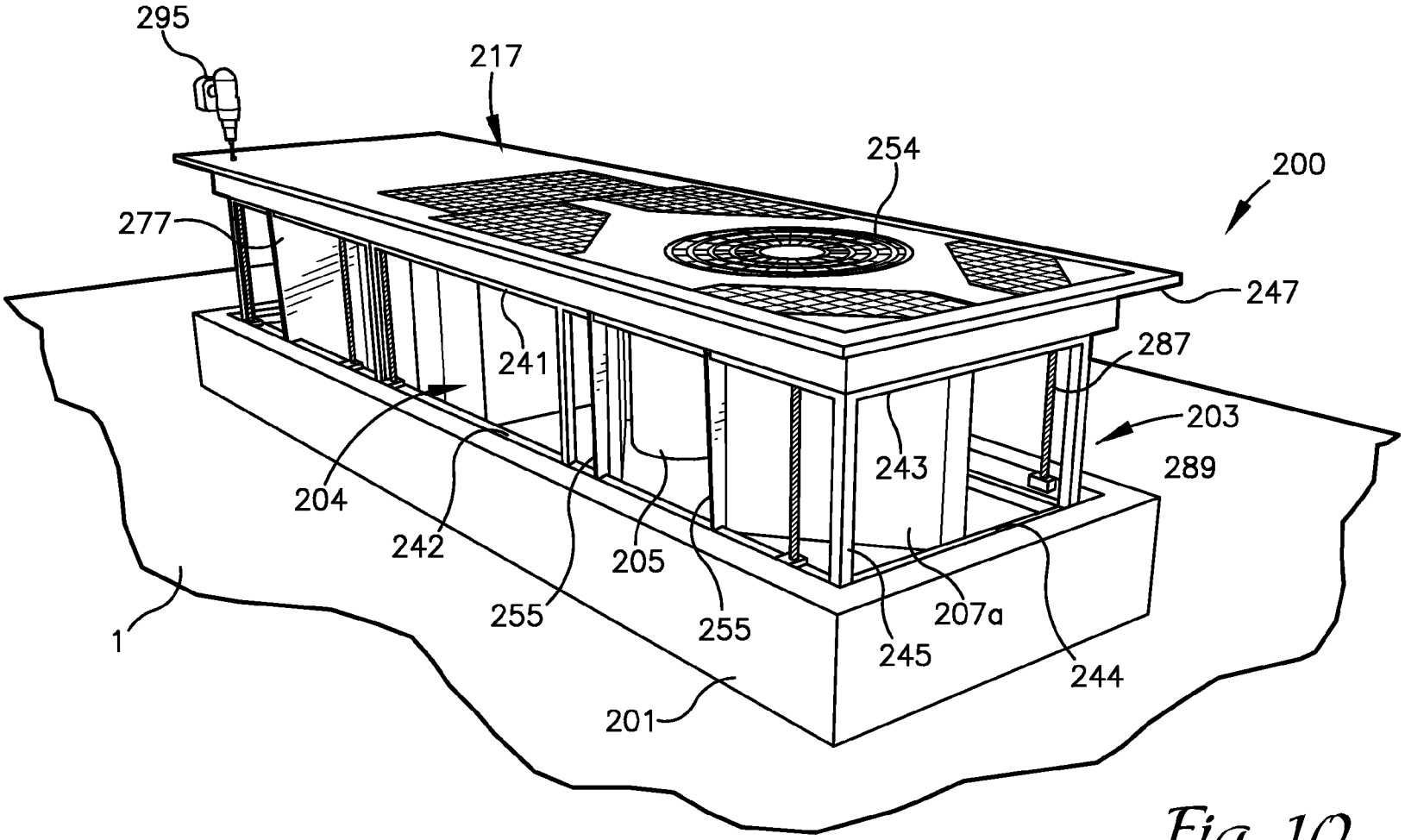
FIG. 10 is a perspective view of an alternative embodiment of the equipment enclosure system showing air conditioning equipment mounted on a chassis which has been raised for service from within an enclosure recessed in a roof.
Figure 11:
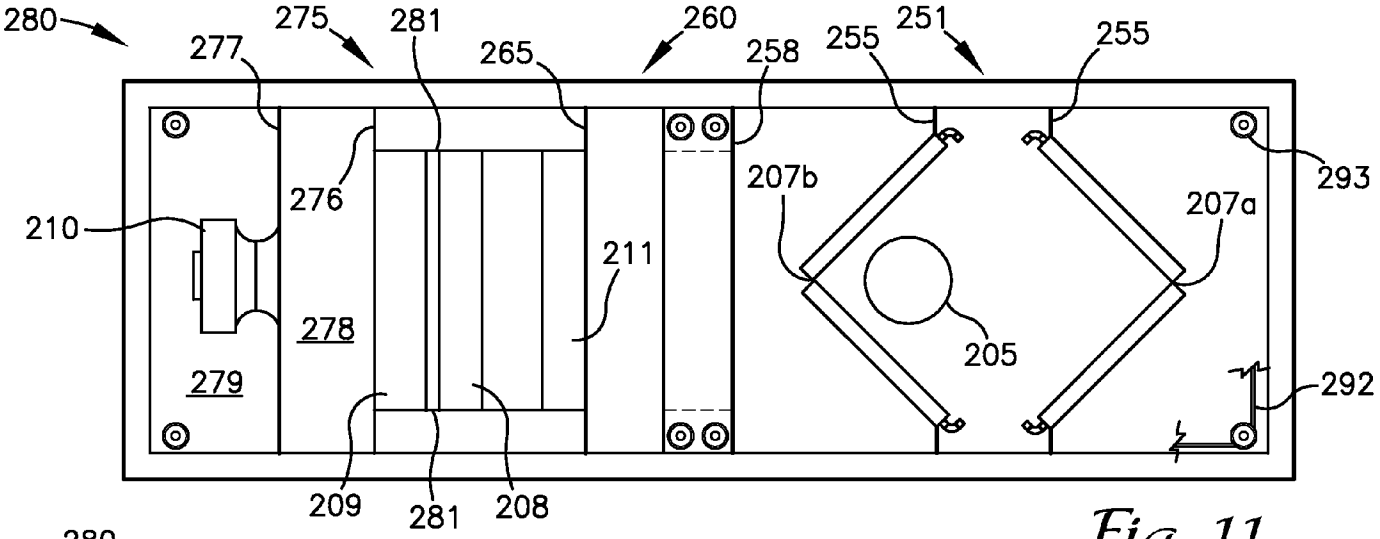
FIG. 11 is a diagrammatic, top view of the equipment enclosure system of the alternative embodiment as shown in FIG. 10 with the chassis and air conditioning equipment lowered into the enclosure and a cover for the enclosure removed.
Figure 12:
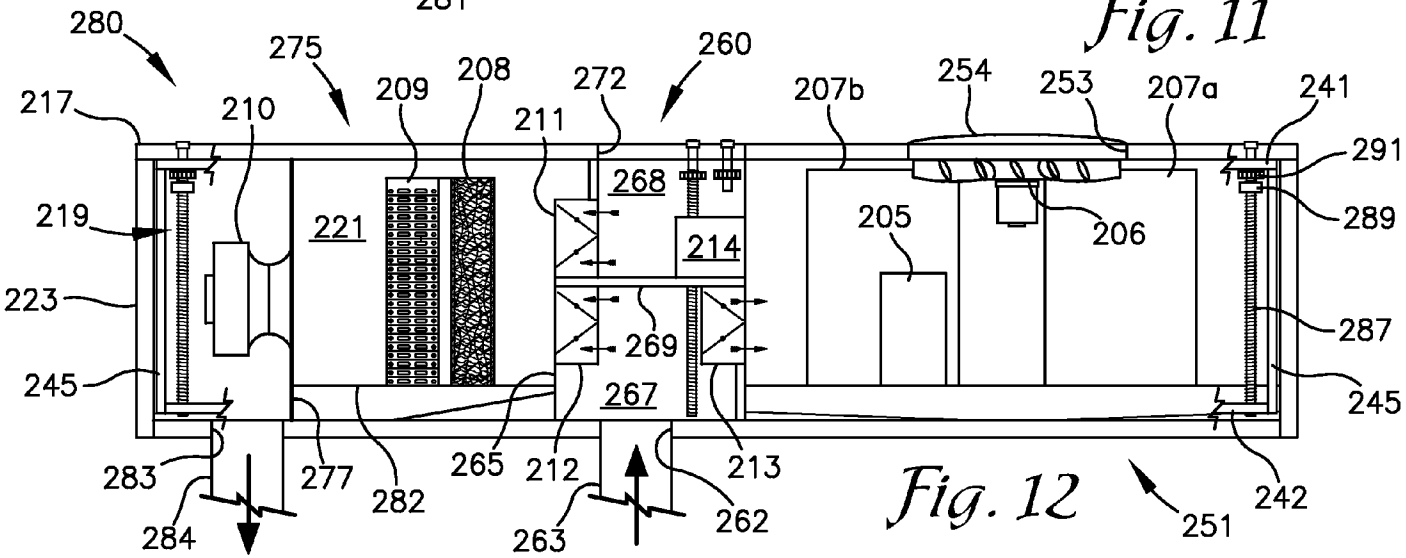
FIG. 12 is a diagrammatic, side view of the equipment enclosure system of the alternative embodiment as shown in FIG. 10 with the chassis and air conditioning equipment lowered into the enclosure and the cover secured over the enclosure.
Figure 13:
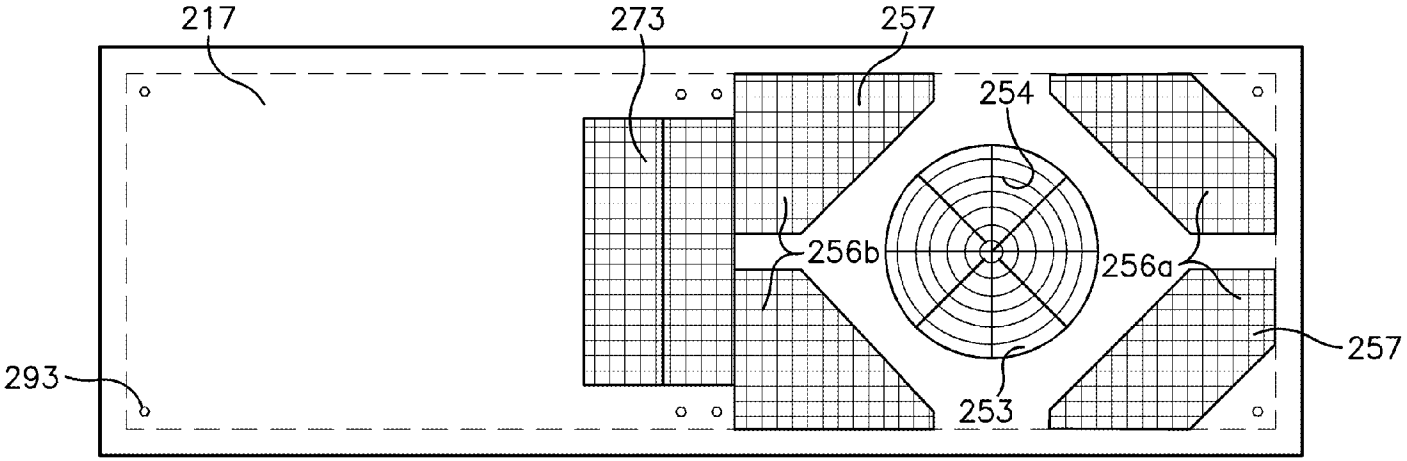
FIG. 13 is a top, plan view of the cover for the enclosure.
Figure 14:
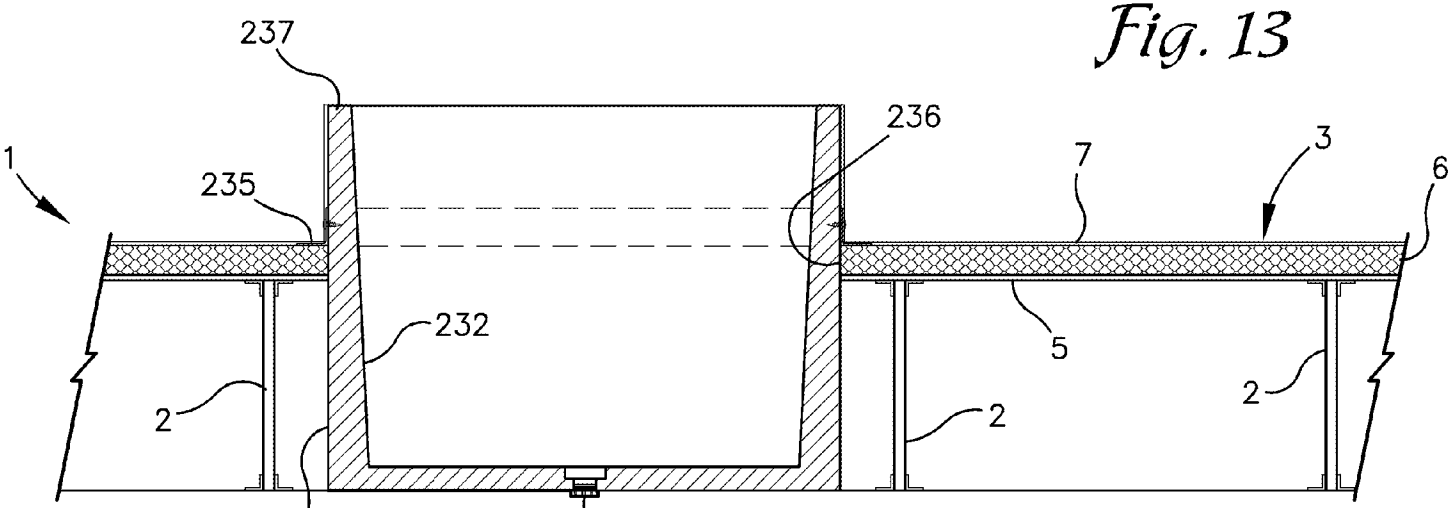
FIG. 14 is a fragmentary, cross-sectional view taken generally along line 14-14 of FIG. 10 showing the enclosure mounted through the roof with the chassis and air conditioning equipment removed.
Figure 15:
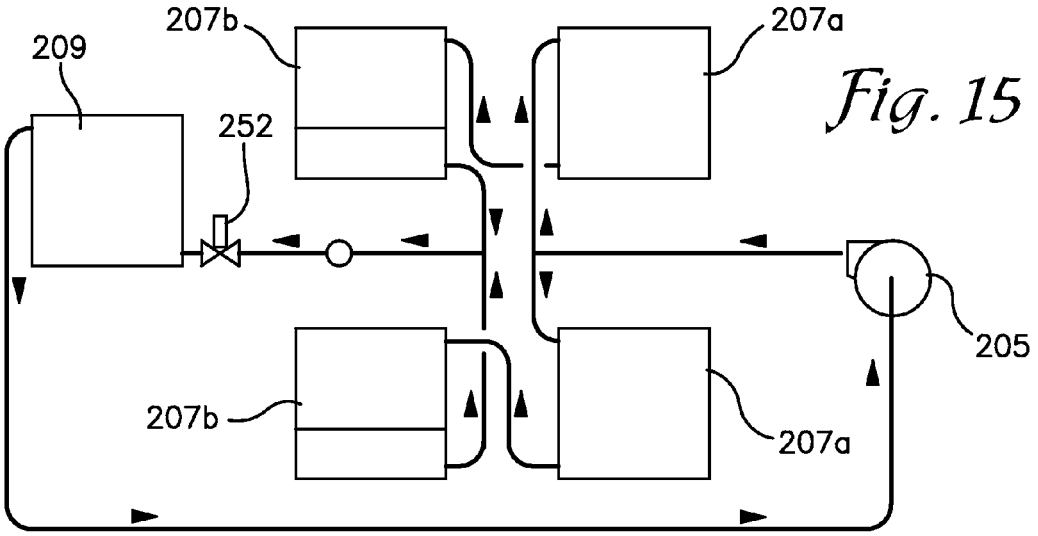
FIG. 15 is a piping diagram of a compressor, heat exchangers and evaporator of the air conditioning equipment of FIG. 10.

The ability to form air tight compartments within the cabinet or equipment enclosure 52 is important to the functionality of the equipment enclosure system 50 of the present invention when the equipment enclosed is air handling equipment such as air conditioning equipment. One approach to providing an air tight compartment is illustrated in FIG. 9. The cabinet 52 is of double wall construction, typically being two or more pieces of metal formed to construct the cabinet side walls 101, end walls (not shown) and bottom 103. Insulating foam is injected or placed in the cavity between the metal panels to form a relatively rigid assembly that has good acoustic, thermal and structural properties. The panels may be shaped to include right angle lip 73 around the periphery of the side walls 101 and end walls for fastening the enclosure to the roof curb 11 using conventional fasteners of appropriate type depending on the materials used for the curb construction. The bottom or floor 103 of the cabinet 52 is generally either flat or sloped to form a drain pan depending on the equipment use. Portions of the cabinet, under components such as the condenser compartments and cooling coil compartments will require a drip or drain pan configuration. The drain pan may drain by gravity or using a pump (not shown).

The interior of the cabinet 52 is preferably smooth and sloped to act as a guide to precisely position the chassis 61 as it is lowered into the cabinet. A plurality of bulkheads are mounted on chassis 61 to form generally air tight compartments within the cabinet 52 around selected components when the chassis 61 is retracted therein. Referring to FIG. 9 a bulkhead 107 is shown extending radially outward from an inlet 111 to the blower 65 which pulls ambient air into the chassis 52, through the filter 66 and past the cooling coils 67 (see FIG. 5). The cooled air is then pushed into a plenum 113 on an opposite side of the bulkhead 107. An opening (not shown) is formed through cabinet 52, such as through the bottom 103 thereof and connected to an air supply duct 56. Pressurized and conditioned air blown into plenum 113 is distributed to the associated building or space through ductwork connected to the air supply duct 56.

The bulkhead 107 is formed around and supported by longitudinal side rails 91 (an additional, upper set of side rails 91 are shown in FIG. 9) and extends upwards to the underside of cabinet cover 54. Side edges 117 of bulkhead 107 match the geometry of the inner surface of the cabinet sidewalls and in the embodiment shown slope inwardly and downwardly. The side edges 117 and bottom edge 118 of the bulkhead 107 are fitted with a perimeter gasket or sealing member 119 to form a leak resistant seal between the side and bottom edges 117 and 118 of the gasket and the inner surfaces of the cabinet sidewalls 101 and bottom 103 when the chassis 61 is fully lowered within cabinet 52. The lowering of the bulkhead 107 compresses the seal due to the mating taper of the bulkhead side edges 1 and the inner surface of the cabinet sidewalls 101. In addition, gasket or seal 72 positioned between the lip 73 and peripheral edge of cabinet cover panel 54 forms a seal between the cabinet 52 and the cabinet cover panel 54 mounted on chassis 61 when the chassis 61 is lowered into cabinet 51. In the event cabinet seals 72 and 119 need to be replaced, the lift mechanism 60 provides complete access to the chassis 61 and bulkheads so these seals can be easily replaced. These seals could be molded or extruded rubber, silicon or similar elastomeric compound suitable for HVAC applications.

Referring to FIGS. 11-16, an alternative embodiment of an equipment enclosure system 200 which may be recessed within a roof 1 is shown. Equipment enclosure system 200 includes a cabinet, equipment enclosure or tub 201 which is adapted to be mounted within a hole through the roof skin 3 and a chassis 203 for supporting mechanical equipment 204, which in the embodiment shown, comprises air conditioning equipment. The mechanical equipment 204 shown include a compressor 205, fan 206, heat exchangers 207, filter 208, evaporator or cooling coil 209, blower 210, outside air damper 211, return air damper 212, exhaust damper 213 and electrical power and control equipment 214. It is to be understood that additional components could be utilized including for example a plurality of compressors 205 and fans 206 depending on the desired functionality and demands on the air handling system 200. An enclosure cover 217 is connected to the top of the chassis 203. The chassis 203 and the attached cover 217 and mechanical equipment 204 mounted thereon are adapted to be raised and lowered relative to the enclosure 201 by lift mechanisms 219.

The enclosure 201 shown may be fabricated from sheet metal in a double walled construction with the interior filled with insulating material. The enclosure 201 includes sidewalls 221, cabinet end walls 223 and cabinet bottom 225. One or more drains 227 may be mounted through the bottom 225 below the cooling coil 209 and also under the compressor 205. The outer surfaces 231 of the sidewalls 221 extend vertically and inner surfaces 232 preferably slope inward and downward. A mounting flange 235 projects outward from outer surfaces 231 of sidewalls 221 and end walls 223 for bolting to the upper surface of the roof 1 around the periphery of a hole 236 formed through the roof skin 3 to receive the enclosure 201. Mounting flange 235 functions as means for securing the enclosure 201 through a hole 236 in the roof 1 or means for mounting the enclosure 201 such that a portion of the enclosure extends through the hole 236 in the roof 1. The flange 235 may be formed by fastening an angle iron around the outer periphery of the sidewalls 221 and end walls 223. In the embodiment shown, the portion of the cabinet sidewalls 221 and end walls 223 extending above the upper surface of the roof 1 function as the roof curb with the roof membrane 7 extended against the exposed portions of the sidewalls and end walls 221 and 223 and folded over the top edge 237 of the cabinet sidewalls and end walls 221 and 223. The width of enclosure 201 is sized such that the portion extending below roof skin 3 fits between adjacent roof structural supports such as trusses 2.

The chassis 203 is formed as a cuboid shaped frame with upper and lower longitudinal rails 241 and 242, upper and lower end rails 243 and 244 and vertical posts 245. The chassis 203 may be formed from two or more frames 240 supporting different sets of components of mechanical equipment 204 and which may be raised or lowered independently to permit a technician to service selected sets of components. The enclosure cover 217 is mounted on or connected to the upper longitudinal rails 241 and upper end rails 243 and includes a lip 247 projecting outward from rails 241 and 243 for engaging the top edge 237 of enclosure 201 when the chassis 203 and cabinet cover 217 are lowered relative to the enclosure 201. A gasket (not shown) may be adhered to or otherwise secured to the underside of the lip 247 to form a seal with top edge 237 of enclosure 201 when the chassis 203 is retracted relative to enclosure 201. The cuboid shaped frame 240 is sized to fit within the interior space of enclosure 201 when lowered relative thereto.

The compressor 205, fan 206 and heat exchangers 207 are mounted on chassis 203 in a condenser section 251. As shown schematically in FIG. 15, compressed by compressor 205 is routed to through air cooled heat exchangers 207 to cool the compressed refrigerant. The compressed refrigerant is pumped by compressor 205 to thermal expansion valve 252 where the pressure decreases abruptly causing the refrigerant to expand, generally to a gas-liquid mixture with a reduced temperature. The reduced temperature refrigerant is routed through the cooling coils 209 where it is completely vaporized by cooling the warmer ambient air or return air blown across the cooling coils 209. The refrigerant vapor returns to the compressor inlet and the cycle is repeated.

The heat exchangers 207 include first and second sets of heat exchangers 207*a* and 207*b* surrounding the compressor 205 and generally surrounding the space immediately below the fan 206. An exhaust outlet 253 is formed in cabinet cover 217 over fan 206 and is covered by a grill 254. Exhaust fan bulkheads 255*a* and 255*b* (which may be constructed in a manner similar to bulkhead 107) are formed around and project outward from each set of heat exchangers 207*a* and 207*b*. Outside air intake openings 256*a* and 256*b* are formed in cabinet cover 217 generally on opposite sides of the exhaust fan bulkheads 255*a* and 255*b* such that operation of fan 206 creates a low pressure area between heat exchangers 207*a* and 207*b* and bulkheads 255*a* and 255*b*, pulling outside air through intake openings 256*a* and 256*b* then through sets of heat exchangers 207*a* and 207*b* respectively to cool the compressed coolant piped therethrough. Screens or grates 257 cover the outside air intake openings 256*a* and 256*b*.

The condenser section 251 is separated from the rest of the chassis 203 by a condenser section bulkhead 258 (which may be constructed in a manner similar to bulkhead 107) to form a seal with equipment enclosure 201 when the chassis 201 is lowered relative thereto. Exhaust damper 213 is mounted against condenser section bulkhead 258 on a side opposite the condenser section 251 and around a return air opening through condenser section bulkhead 258.

The exhaust damper 213 is mounted in an air intake section 260. A return air inlet 262 is formed in the cabinet bottom 225 below the air intake section 260 of chassis 203. A return air duct 263 is connected to the cabinet bottom 225 around and in air flow communication with return air inlet 262. An air intake section bulkhead 265 is connected to the chassis 203 in spaced relation from the condenser section bulkhead 258. The air intake section 260 is further divided into a return air section 267 and an outside air section 268 by an insulated divider panel 269 vertically bisecting the air intake section 260. The return air damper 212 is mounted on the air intake section bulkhead 265 around a return air opening extending therethrough and below the insulated divider panel 269. The outside air damper 211 is mounted on the air intake section bulkhead 265 around an intake air opening extending therethrough and above the insulated divider panel 269. Air intake section bulkhead 265 may also be constructed in a manner similar to bulkhead 107 to form a seal with enclosure 201 when the chassis 201 is lowered relative thereto.

A supply air intake opening 272 is formed in cabinet cover 217 above the air intake section 260 and may be covered by a screen or grate 273. The electrical power and control equipment 214 may be supported on insulated divider panel 269 in air intake section 260.

The filter 208 and evaporator 209 are mounted on chassis 203 in a cooling section 275 defined by the air intake section bulkhead 265 on one end and a cooling section bulkhead 276 on an opposite end thereof. A supply section bulkhead 277 (similar in construction to bulkhead 107) is formed on the chassis 203 in spaced relation from the cooling section bulkhead 276 and on a side thereof opposite the evaporator 209 and filter 208. The blower 210 is mounted on the supply section bulkhead 277 around a supply opening and on a side of supply section bulkhead 277 opposite cooling section bulkhead 276. The space between the cooling section bulkhead 276 and the supply section bulkhead 277 forms a negative pressure plenum 278 and the space on the opposite side of the supply section bulkhead 277 forms a positive pressure plenum 279. The positive pressure plenum 279 generally comprises the supply section 280 of chassis 203. Blower 210 pulls air through supply air intake 272 and return air inlet 262, through outside air damper 211 and return air damper 212, through the filter 208 and evaporator 209 (which cools the air) then through blower 210 and into the supply section 280. Sidewalls 281 and a floor 282 form an enclosure around evaporator 209 and blower 210 to prevent intake air from short circuiting around the components.

A supply air outlet 283 is formed through enclosure 201 to open into the space surrounding the supply section 280. In the embodiment shown, the supply air outlet 283 is formed in the cabinet bottom 225. A supply air duct 284 is connected to the cabinet bottom 225 around and in air flow communication with supply air outlet 283.

The portion of the cabinet cover 217 extending over the cooling section 275, the negative pressure plenum 278 and the positive pressure plenum 279 is insulated and may be formed from a double walled sheet metal construction with a layer of insulation therebetween. Additional insulation or insulating panels may be used as appropriate on the chassis 203 to improve efficiency.

Lifting mechanisms 219 shown are constructed similar to lifting mechanisms 60 and include a threaded shaft or acme screw 287, rotatably connected at an upper end to the enclosure cover 217 and extending therethrough. The threaded shaft 287 is aligned with and extends through upper and lower longitudinal rails 241 and 242 of frame 240 and the lower end of threaded shaft 287 is rotatably connected to lower longitudinal rail 242. The threaded shaft 287 of each lifting mechanism 219 also extends through a threaded bearing 289 mounted on enclosure sidewall 221. A sprocket 291 is mounted on shaft 287 below the enclosure cover 217 and upper longitudinal rail 241. A lift screw 287 is preferably mounted proximate each corner of the chassis 201 and a continuous timing belt 292 engages each sprocket. Additional lift screws 287 may be utilized as needed. A socket 293 is formed in the end of one or more of the acme screws 287 for engagement by a tool bit connected to a power drill 295 or the like for use in rotating the interconnected acme screws 287 and raising or lowering the chassis 203 relative to enclosure 201. If the chassis 203 is formed from multiple frames, separate belts for separate sets of drive screws in the corners of each frame may be used to independently raise or lower the individual frames.

Figure 16:
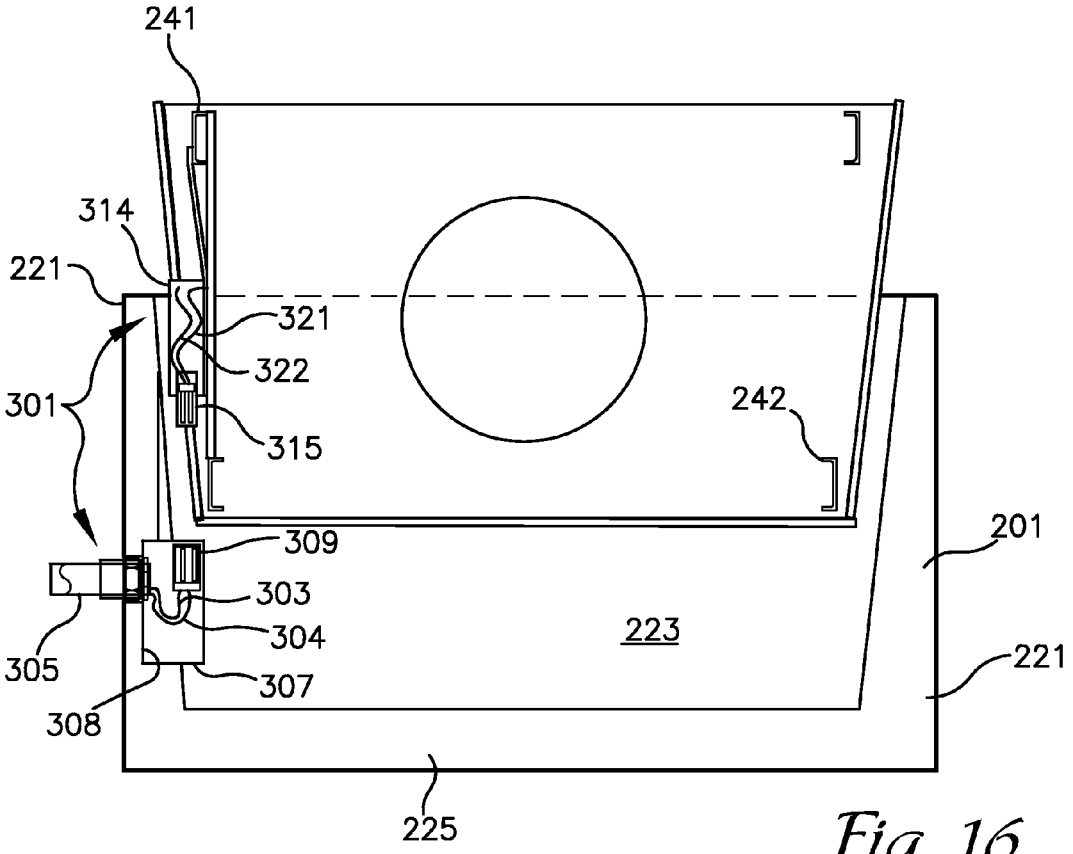
FIG. 16 is a diagrammatic, cross-sectional view similar to FIG. 14 showing the enclosure with the chassis and air conditioning equipment in a partially raised position and showing a power supply plug assembly mounted on the chassis and a power supply receptacle assembly mounted on the enclosure.
Figure 17:
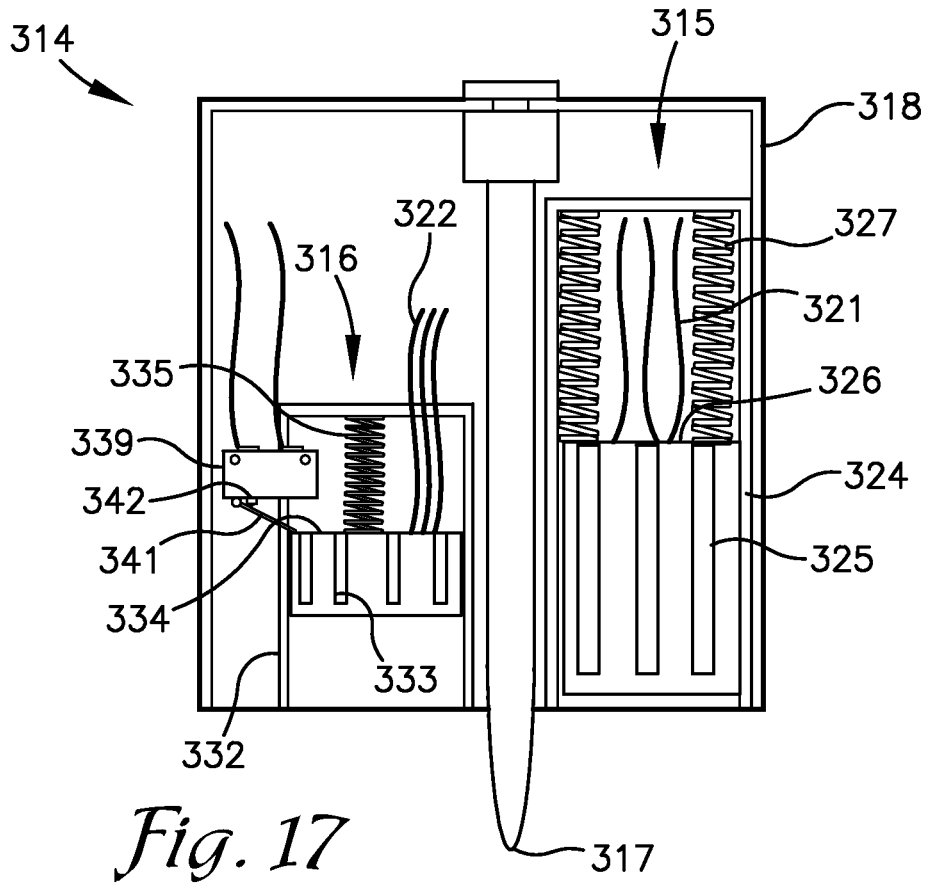
FIG. 17 is a diagrammatic view of the power supply plug assembly with portions removed to show detail.
Figure 18:
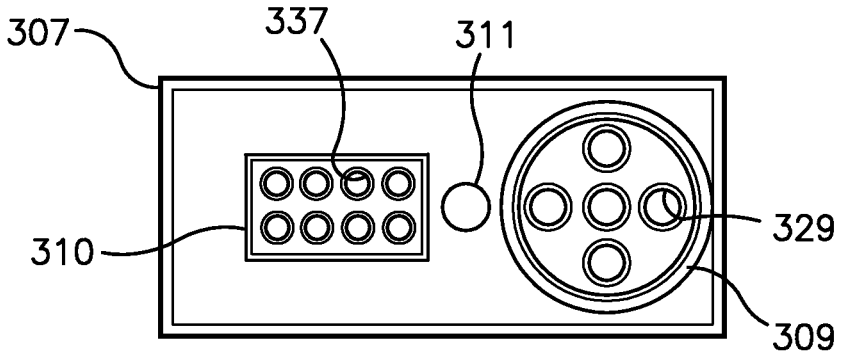
FIG. 18 is an end view of the power supply receptacle.

Referring to FIGS. 16-18, an electrical power disconnection assembly 301 is shown integrated into the equipment enclosure system 200. Power supply conductors 303 are routed from a power source and through an electrical conduit 305 which extends through enclosure sidewall 221 and is connected to a junction box 307 mounted on an inner surface of enclosure sidewall 221. Junction box 307 may be mounted within a groove or recess 308 formed in an inner surface of sidewall 221 so that the junction box 307 is spaced outward from the lower longitudinal rail 242 of frame 240 so as not to interfere with retraction of the chassis 203 to the retracted position in enclosure 201. A knockout may be formed in the material forming sidewall 221 which is easily removed during installation to route the conduit 305 and conductors 303 therethrough. Lower voltage, system control conductors 304 may also be routed through conduit 305 or a separate conduit connected to junction box 307 through sidewall 221.

A power supply receptacle 309 and a control receptacle 310 are mounted in the junction box 307 on opposite sides of an alignment pin receiver 311. The higher voltage power supply conductors 303 terminate at the power supply receptacle 309 and the lower voltage control conductors 304 terminate at the control receptacle 310.

A plug assembly 314 is mounted on the chassis 203 in vertical alignment with junction box 207. Plug assembly 314 includes a power supply plug 315 and a control plug 316 mounted on opposite sides of an alignment pin 317 and within plug assembly housing 318. Power supply conductors 321 are routed from power supply plug 315 to mechanical equipment such as compressor 205, fan 206 and blower 210. Control conductors 322 are routed from control plug 316 to the control equipment 214. Plug assembly housing 318 is shown mounted on a bracket 323 connected to upper and lower longitudinal rails 241 and 242 of frame 240 with the plugs 315 and 316 and alignment pin 317 pointing downward. When chassis 203 is fully retracted into enclosure 201, power supply plug 315 and control plug 316 electrically couple with power supply receptacle 309 and control receptacle 310 respectively. When chassis 203 is raised relative to enclosure 201, plugs 315 and 316 electrically disconnect or uncouple from receptacles 309 and 310 respectively to disconnect the power and control signal to the mechanical equipment 204 to allow an operator to safely work on the equipment.

Power supply plug 315 is mounted within a non-conductive tube or sleeve 324 in housing 318 and includes a plurality of high voltage conductor pins 325 mounted on plate 326 within tube 324. Plate 326 is spaced from a rear or inner wall of tube 324 by springs 327. Power supply conductors 321 are electrically connected to the conductor pins 325. The power supply receptacle 309 includes a plurality of conductive, pin receiving sleeves 329 corresponding in number and arrangement as the conductor pins 325.

Control plug 316 is mounted within a non-conductive tube or sleeve 332 in housing 318 and includes a plurality of low voltage control pins 333 mounted on plate 334 within tube 332. Plate 332 is spaced from a rear wall of tube 332 by springs 335. Control conductors 322 are electrically connected to the control pins 333. The control receptacle 310 includes a plurality of conductive, pin receiving sleeves 337 corresponding in number and arrangement to the control pins 333.

Pin mounting plates 326 and 334 and attached conductor pins 325 and control pins 333 slide within their respective sleeves 324 and 332. A plunger type micro-switch 339 is mounted within plug assembly housing 318 proximate the control plug sleeve 332 and a lever arm actuator 341 is connected between the micro-switch 339 and the pin mounting plate 334 over a plunger 342 on switch 339.

Conductor pins 325 are longer than control pins 325. In addition, control pins 333 are recessed further in sleeve 332 than conductor pins 325 are recessed within sleeve 324. When plug assembly 314 is advanced into engagement with junction box 307, conductor pins 325 engage sleeves or receivers 329 in power supply receptacle 309 before control pins 333 engage control pin sleeves 337 in control receptacle 310. When control pins 333 are fully inserted in control pin sleeves 337 further advancement of control plug 316 toward control receptacle 310 causes receptacle 310 to compress plate 334 rearward or upward against springs 335 and pivoting lever arm actuator 341 against plunger 342 closing switch 339 which results in power being supplied to control equipment 214. Supplying power to control equipment 214 turns on or allows power to be supplied to mechanical equipment 204 such as compressor 205, fan 206 and blower 210 through the connection between power supply plug 315 and power supply receptacle 309.

When the chassis 203 is raised relative to enclosure 201 the plug assembly 314 is separated from junction box 307. When control receptacle 310 is pulled away from control plug 310, plate 334 initially moves away from lever arm actuator 341 which allows spring loaded plunger 342 to return to an open position opening switch 339 which shuts off the electrical load to the mechanical equipment 204 which should prevent arcing between power supply plug 315 and power supply receptacle 309 as they are separated. In addition, because control pins 333 are shorter than conductor pins 325, the control pins 333 are withdrawn from electrical connection with control pin receivers 37 before conductor pins 325 are withdrawn from electrical connection with conductor sleeves 329 which also electrically disconnects the mechanical equipment 204 before conductor pins 325 are fully withdrawn from conductor sleeves 329 so that they do not unintentionally arc.

It is to be understood that while certain forms of the present invention have been illustrated and described herein, it is not to be limited to the specific forms or arrangement of parts described and shown. It is to be understood that the equipment enclosure system disclosed herein could be used in a roof extending over a pit or the like proximate a building or facility to which air, fluids or electrical power are to be supplied or distributed using the mechanical equipment enclosed in the equipment enclosure. The roof through which the equipment enclosure extends may be formed at ground level or extend below. It is also to be understood that the equipment enclosure system could be adapted to mount within a vertical wall with the enclosure extending into an interstitial space between an exterior and interior wall and the chassis mounted to move horizontally out of and back into the enclosure.

As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed is:

1. An equipment enclosure assembly in combination with mechanical equipment for building systems or processes comprising a heating or cooling element and a blower; said equipment enclosure assembly including:

an enclosure with an open top;

a chassis supporting the mechanical equipment, said chassis moveable between a lowered position in which said chassis and said mechanical equipment are retracted within said enclosure and a raised position in which said chassis and said mechanical equipment are raised relative to said enclosure to provide access to said mechanical equipment;

a cover mounted on said chassis over said mechanical equipment and advanceable into and out of covering relationship with said open top of said enclosure;

a positive pressure plenum formed in said enclosure when said chassis is advanced to said lowered position;

said blower positioned on said chassis and operable to pull air into said enclosure through one or more air inlet openings in said enclosure or said cover and past said heating or cooling element and then advance the air into the positive pressure plenum.

2. The equipment enclosure assembly as in claim 1 further comprising means for securing said equipment enclosure through a hole in a roof of a structure such that the a portion of said equipment enclosure extends below the roof.

3. The equipment enclosure system as in claim 1 further comprising means for securing said equipment enclosure through a hole in a roof of a structure such that a portion of said equipment enclosure extends into interstitial space below the roof.

4. The equipment enclosure system as in claim 1 wherein said positive pressure plenum is formed in part by a bulkhead on said chassis which seals against an inner surface of said enclosure when said chassis is lowered into said enclosure, and wherein an air outlet is formed through said enclosure and opens into said positive pressure plenum.

5. The equipment enclosure system as in claim 1 further comprising first and second sets of power supply conductors for supplying power from a power source to components of the mechanical equipment; said first set of power supply conductors routed through said enclosure and said second set of power supply conductors mounted on said chassis and positioned such that advancement of said chassis to said lowered position advances said second set of power supply conductors into electrical connection with said first set of power supply conductors and advancement of said chassis to said raised position electrically disconnects said second set of power supply conductors from said first set of power supply conductors.

6. The equipment enclosure system as in claim 1 further comprising first and second sets of power supply conductors for supplying power from a power source to components of the mechanical equipment and first and second mating connectors electrically connecting said first set of power supply conductors to said second set of power supply conductors; said first mating connector mounted on said enclosure and said second mating connector mounted on said chassis such that advancement of said chassis to said lowered position advances said second mating connector into electrical connection with said first mating connector and advancement of said chassis to said raised positions electrically disconnects said second mating connector from said first mating connector.

7. A method of installing on a roof of a structure mechanical equipment for building systems or processes comprising a heating or cooling element and a blower, the method comprising:

a) providing an enclosure having an open top and a chassis moveable between a lowered position in which said chassis is retracted within said enclosure and a raised position in which said chassis is raised relative to said enclosure;

b) installing the mechanical equipment in the enclosure and on said chassis such that access is provided to said mechanical equipment when said chassis is raised relative to said enclosure;

c) mounting a cover relative to the enclosure which selectively covers the open top of the enclosure such that a positive pressure plenum is formed in said enclosure when said chassis is advanced to said lowered position;

d) forming a hole through the roof;

e) securing the enclosure to the structure such that a portion of the enclosure extends through the hole in the roof; and f) positioning said blower on said chassis such that the blower is configured to operate to pull air into said enclosure through one or more air inlet openings in said enclosure or said cover and past said heating or cooling element and then advance the air into the positive pressure plenum.

8. The method as in claim 7 wherein the step of securing the enclosure to the structure includes securing the enclosure such that a portion of sidewalls of the enclosure extend above the roof.

9. The method as in claim 7 wherein the step of securing the enclosure to the structure includes securing the enclosure such that a portion of said enclosure extends into an interstitial space below the roof.

10. The method as in claim 7 wherein the step of mounting the cover comprises mounting the cover to the chassis and over the equipment.

11. A method of installing on a roof of a structure mechanical equipment for building systems or processes comprising a heating or cooling element and a blower in which the roof includes a layer of insulation supported on roof decking, the method comprising:

a) providing an enclosure having an open top and a chassis moveable between a lowered position in which said chassis is retracted within said enclosure and a raised position in which said chassis is raised relative to said enclosure;

b) installing the mechanical equipment in the enclosure and on said chassis such that access is provided to said mechanical equipment when said chassis is raised relative to said enclosure;

c) mounting a cover relative to the enclosure which selectively covers the open top of the enclosure such that a positive pressure plenum is formed in said enclosure when said chassis is advanced to said lowered position;

d) forming a hole in the roof extending at least down to the roof decking;

e) forming a curb around the hole in the roof;

f) positioning the enclosure on the roof such that at least a portion of the enclosure is recessed within the curb and into the hole formed in the roof; and g) positioning said blower on said chassis such that the blower is configured to operate to pull air into said enclosure through one or more air inlet openings in said enclosure or said cover and past said heating or cooling element and then advance the air into the positive pressure plenum.

* * * * *